US011959242B2

(12) United States Patent
Bennani Braouli et al.

(10) Patent No.: US 11,959,242 B2
(45) Date of Patent: Apr. 16, 2024

(54) DEVICE FOR CONTAINING GRANULAR ELEMENTS

(71) Applicant: SOLETANCHE FREYSSINET, Rueil Malmaison (FR)

(72) Inventors: Yassine Bennani Braouli, Croissy S/Seine (FR); Nicolas Freitag, Le Vesinet (FR)

(73) Assignee: SOLETANCHE FREYSSINET, Rueil Malmaison (FR)

( * ) Notice: Subject to any disclaimer, the term of this patent is extended or adjusted under 35 U.S.C. 154(b) by 220 days.

(21) Appl. No.: 17/292,242

(22) PCT Filed: Nov. 8, 2019

(86) PCT No.: PCT/FR2019/052671

§ 371 (c)(1),
(2) Date: May 7, 2021

(87) PCT Pub. No.: WO2020/095007

PCT Pub. Date: May 14, 2020

(65) Prior Publication Data

US 2021/0404137 A1 Dec. 30, 2021

(30) Foreign Application Priority Data

Nov. 9, 2018 (FR) ..... 18 60405

(51) Int. Cl.
*E02D 29/02* (2006.01)
*B21F 27/12* (2006.01)

(52) U.S. Cl.
CPC ..... *E02D 29/0266* (2013.01); *B21F 27/12* (2013.01); *E02D 29/0225* (2013.01); *E02D 2200/13* (2013.01); *E02D 2250/00* (2013.01); *E02D 2300/0034* (2013.01);
(Continued)

(58) Field of Classification Search
CPC ..... E02D 29/0266; E02D 29/0225; E02D 2200/13; E02D 2300/0034; E02D 2300/0079; E02D 2300/0085; E02D 2300/0087; E02D 29/0241
See application file for complete search history.

(56) References Cited

U.S. PATENT DOCUMENTS 5,733,072 A 3/1998 Hilfiker et al.
6,345,934 B1 2/2002 Jailloux et al.
8,967,917 B1 3/2015 Hilfiker, Jr.
(Continued)

FOREIGN PATENT DOCUMENTS

CL 2009000847 A1 6/2010

OTHER PUBLICATIONS

International Search Report (with English translation) and Written Opinion issued in PCT/FR2019/052671, dated Feb. 12, 2020, 11 pages.

*Primary Examiner* — Carib A Oquendo
(74) *Attorney, Agent, or Firm* — HSML P.C.

(57) ABSTRACT

Disclosed is a device for containing granular elements, comprising a metal mesh panel having metal wires welded together, the panel comprising at least one curvature of a first orientation and at least one curvature of a second orientation, the first orientation being characterized by a first axis and the second orientation being characterized by a second axis, the first axis and the second axis being non-collinear.

17 Claims, 2 Drawing Sheets

(52) U.S. Cl.
CPC ..... *E02D 2300/0079* (2013.01); *E02D 2300/0085* (2013.01); *E02D 2300/0087* (2013.01)

(56) References Cited

U.S. PATENT DOCUMENTS

| | | | | |
|---|---|---|---|---|
| 2011/0027016 | A1* | 2/2011 | Blouin | E02D 17/20 405/16 |
| 2011/0058904 | A1 | 3/2011 | Freitag | |
| 2011/0311318 | A1* | 12/2011 | Taylor | E02D 29/0225 405/262 |
| 2014/0203233 | A1* | 7/2014 | Larsen | E04H 17/161 256/32 |
| 2015/0132069 | A1* | 5/2015 | Taylor | E02D 29/0241 405/284 |
| 2017/0138013 | A1* | 5/2017 | Woolbright | E02D 29/0225 |
| 2018/0295791 | A1* | 10/2018 | Calle | A01G 25/02 |

* cited by examiner

DEVICE FOR CONTAINING GRANULAR ELEMENTS

BACKGROUND

The invention relates to the field of structures comprising contained granular elements, for example reinforced soil structures, and can in particular be applied to a facing member of such a structure. This construction technique is commonly used to create structures such as retaining walls, bridge abutments, etc. It can also apply to the field of cladding which comprises containing granular elements along a pre-existing structure in order to give it a mineral appearance.

Such structures associate granular elements forming a compacted fill, a device containing these granular elements and forming a facing, and reinforcements generally connected to the facing. The device containing the granular elements generally comprises a plurality of members assembled together.

Various types of reinforcement, generally longitudinal, may be used: they may be of metal, for example galvanized steel, or of synthetic materials, such as materials referred to as geotextiles or comprising polyester fibers.

Similarly, different types of containing devices can be used: they may also be of metal, for example galvanized steel, or of synthetic materials, such as materials referred to as geotextiles comprising for example polyester fibers. The containing device generally constitutes the external facade of the structure and must therefore be resistant to wear, in particular to oxidation, while retaining a pleasant aesthetic.

The external facade of the structure may include horizontal recesses between different levels of facing. It may also be sloped, in general with a larger initial surface area at the ground than at the top of the structure, but it is also possible to build structures with overhanging facings.

The reinforcements placed in the granular fill may be more or less densely distributed. They are secured to the containing device by means of connection devices which can take various forms. The reinforcements make it possible to transmit high loads of up to several tons.

In order to fulfill its containment role, it is important that the device for containing the granular elements has significant rigidity. This rigidity is traditionally enabled by the reinforcements: the arrangement of the connection points between the reinforcements and the containing device makes it possible to increase the rigidity in certain directions. However, the distribution of the loads at these points is difficult to predict.

It is therefore also known to use a containing device having parallel and horizontal corrugations or bends, in order to increase the mechanical resistance to stresses exerted in a given direction. This type of corrugations or bends is similar to what is used in corrugated sheet metal or in fencing.

However, these horizontal bends do not increase the rigidity in all directions. Under the effect of pressure exerted by the granular elements, this leads to the formation of undesirable bulges in the facade. To overcome these disadvantages, containing devices are therefore used which comprise a metal mesh made of very thick galvanized steel wires.

The use of previously galvanized very thick steel wires is problematic for more than one reason. First of all, it is difficult to produce a mesh from galvanized steel wires that are of large diameter. Indeed, the welding points between the wires may come into contact with the steel through the galvanized coating, and at the cut ends a large part of the mesh cross-sectional area is not protected and can therefore quickly present local corrosion points. In addition, it is difficult to obtain large amounts of this type of wire. Generally, a galvanization step must be carried out after production of the steel mesh, which considerably complicates the production of the structure. Finally, the use of a large amount of steel means significant volatility in the cost of the structure. Indeed, the price of steel is subject to fluctuations which can turn out to be considerable at the time scale for completion of such a structure.

There is therefore a need for a new means of increasing the rigidity of a device for containing granular elements, and for doing so in several directions.

SUMMARY

The invention achieves this by means of a device for containing granular elements, comprising a metal mesh panel comprising metal wires welded together, the panel comprising at least one curvature of a first orientation and at least one curvature of a second orientation, the first orientation being characterized by a first axis and the second orientation being characterized by a second axis, wherein the first axis and the second axis are not collinear.

The device for containing granular elements is typically a facing member or an association of facing members for a civil engineering structure such as a reinforced soil structure.

The granular elements are preferably mineral in nature. These may be elements originating from scrap from a quarry or from mining works for example. These may also be soil suitable for plant growth in order to give plant cover to the structure. Finally, it may also be an engineered fill. These elements preferably have a highly dispersed particle size distribution.

The device comprises a metal mesh panel. The panel according to the invention is a monolithic member capable of distributing a stress applied to it. A metal mesh within the meaning of the invention is a grid of integrally connected metal wires. These metal wires are preferably arranged in two orientations, for example two perpendicular orientations, so as to form the grid of the mesh similar to wire fencing.

The mesh size of this grid must be small enough to contain the granular elements. If the granular elements have a smaller particle size than the spacing of the metal mesh, the mesh may be provided with a secondary mesh having a finer mesh size than the granular elements: the metal mesh may be associated with a secondary mesh having a mesh size of smaller characteristic dimensions than the metal mesh. Such a secondary mesh may be less rigid and may be selected for example among a woven mesh, a biomat, or a geotextile.

The nodes of the metal mesh grid are provided by weld points between the metal wires. Preferably, this welding is welding with no added fillers such as electro-welding. Welding without added fillers ensures interpenetration of the wires and therefore better solidarity of the metal wires and better transmission of stresses.

The metal mesh may have wires of different diameters in order to present a different rigidity depending on the direction in which it is stressed. This can advantageously allow adapting the mesh to the use to be made of it.

Said at least one curvature of a first orientation may consist of a series of bends in the mesh that are parallel to each other, for example horizontal. This at least one curvature of the mesh makes it a three-dimensional object and considerably increases its rigidity by limiting its propensity to undergo deformation in a direction different from that of the curvature. From a mechanical point of view, this at least one curvature is equivalent to a beam.

Said at least one curvature of a second orientation may also consist of a series of bends in the mesh that are parallel to each other but not parallel to said at least one curvature of a first orientation. The creation of this second at least one curvature acts similarly to the at least one curvature of a first orientation, and makes it possible to increase the rigidity in another direction.

The first axis and the second axis are for example perpendicular, preferably the first axis and the second axis are each parallel to a plurality of metal wires. Thus, if the metal mesh has wires in two directions, the curvatures are produced in these two directions. This advantageously makes it possible to position at least one metal wire along each curvature and thus reinforce the device.

In order to be able to produce curvatures in different directions, several solutions are conceivable.

In a preferred embodiment, said at least one curvature of a first orientation guides a limited number of wires, preferably a single wire, out of the plane of the mesh before the curvature. The out-of-plane wire or wires are advantageously shorter than the others so as to allow the production of the at least one curvature of a second orientation at a level of the panel where this wire or these wires are not present.

Alternatively, the curvatures of a first and second orientation may be combined in the form of a multiple curvature such as a dome. A domed deformation in the mesh is highly advantageous from a rigidity point of view. It can be produced by stamping or by using 3D techniques for printing a shell, for example.

Thus, although the axes of the various curvatures are preferably rectilinear, it is quite possible for them to be curved.

According to a third alternative, the curvatures of the first and second orientations are ensured by adding members onto the mesh after the fact. These members can have a V shape and be welded to a mesh already having bends in another direction.

The device according to the invention has increased rigidity due to its geometric shape. This rigidity can compensate for a smaller metal wire diameter, which is particularly advantageous as indicated above. The metal diameter of the various metal wires of the metal mesh is preferably greater than 4 mm, to ensure a minimum resistance. However, it is preferably between 5 and 8 mm and in any event is less than 12 mm, unlike the wires used in metal meshes of the prior art which conventionally have a diameter of up to 14 mm, or even 18 mm. We can thus reduce the mass of metal used, by more than half, while eliminating any subsequent galvanization step as explained above.

The device for containing granular elements according to the invention preferably comprises several curvatures of a first orientation and/or several curvatures of a second orientation. When the mesh comprises a substantially planar portion, these curvatures are for example arranged to guide a metal wire out of the plane of said portion of the metal mesh, preferably substantially parallel to said plane.

In this case, the out-of-plane metal wire preferably has a shorter length than the majority of the metal wires of the metal mesh. This allows generating a curvature in a different direction, at the plane extending beyond the wire.

At least one curvature can guide a portion of the device according to the invention out of the plane intended to become the facade of the structure in which it is to be incorporated. This portion can contribute to the robustness of the structure and improve the stability of the whole.

At least one curvature can also result in a folding over the granular elements. This folding can have both a protective function for the granular elements and a load distribution function in the event of an impact on the facade.

Said at least one curvature of a first orientation and said at least one curvature of a second orientation may be or comprise bends. The bends in the meaning of the invention are curvatures or are capable of being obtained by bending the metal mesh panel around a mandrel.

Preferably, an arrangement of curvatures is configured to allow the device to be auto-stable. In addition to the obvious advantage of this within a structure, having a auto-stable device is also of interest from the point of view of storing the device.

To this end, the curvatures may also advantageously be arranged so as to allow stacking the devices according to the invention.

According to another aspect, the invention relates to a method for manufacturing a device for containing granular elements according to the invention, comprising a first step of bending a metal mesh in a first direction and a subsequent step of bending the metal mesh in a second direction that is not collinear with the first direction.

The bending steps are for example carried out by applying force to the mesh around a mandrel. The diameter of the mandrel can lead to more or less sharply angled curvatures. Preferably the curvatures are not too sharply angled, as this leads to a risk of damage to the metal wires. Conversely, the curvatures are preferably not too progressive in order to limit the space they occupy.

Advantageously, the galvanization of the wires consists of a coating of zinc or a zinc-aluminum alloy. The metal mesh thus preferably comprises wires provided with a metal coating, the metal coating preferably being selected among zinc or an alloy comprising zinc and/or aluminum.

The method according to the invention may include other steps, for example a step of cutting an out-of-plane metal wire. This cutting step may be after the creation of a first curvature. However, in a particularly advantageous embodiment, the mesh is designed by anticipating future curvatures and directly integrating shortened metal wires at the time when the welding points between wires are created.

According to a third aspect, the invention relates to a reinforced soil structure comprising:

- a device for containing granular elements according to any one of the preceding claims,
- a plurality of granular elements contained by said device, the granular elements preferably being mineral in nature,
- at least one soil reinforcement member of metal or polymer.

Said soil reinforcement member of metal may be implemented as a continuity of the material of the containing device.

The features described above may be implemented independently of each other or in combination with one another.

BRIEF DESCRIPTION OF THE DRAWINGS

Other features, details, and advantages of the invention will be apparent from reading the detailed description below, and from analyzing the appended drawings, in which.

DESCRIPTION OF EMBODIMENTS

The drawings and description below for the most part contain elements that are certain in nature. Therefore not only can these serve to provide a better understanding of the invention, but they also contribute to its definition, where appropriate.

Figure 1:
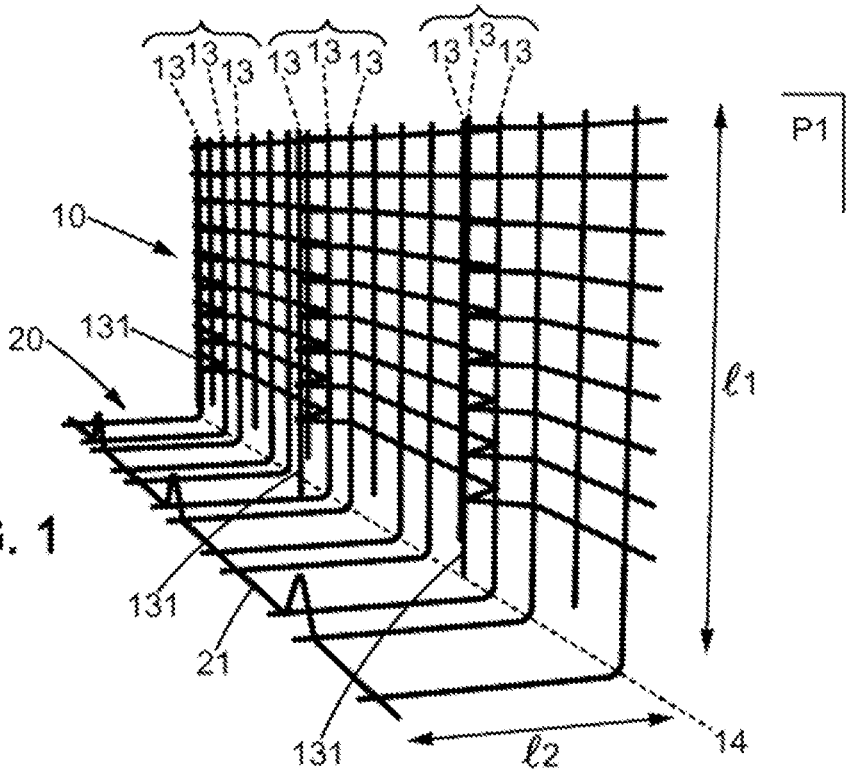
FIG. 1 is a perspective view of a device for containing granular elements according to one embodiment of the invention.

Reference is now made to FIG. 1. In the context of the exemplary embodiment illustrated, the containing device according to the invention is used as a facing member for a reinforced soil structure. The facing member is intended to be associated with other similar members which will be arranged one below the other.

The member is obtained from a metal mesh of galvanized steel wires that are electro-welded when flat. The wires have a diameter of 6 mm. The welding step is done with no added filler, by locally inducing a very high electric field locally at the intersections of the wires. This causes localized heating, and an interpenetration of the wires takes place. The welding can be automated and be done on a conveyor belt.

The wires assembled during formation of the mesh do not all have the same length. Thus, in one dimension, one wire out of two has a long length l1+l2 and one wire out of two has a short length l1.

The mesh thus obtained then undergoes a first series of bends 13 in a first direction. These bends are grouped in series of three bends. In the figure, three series of three bends are represented, but the member may have more.

The illustrated member comprises a first face 10 intended to be positioned on the facade of the structure. This first face 10 lies within a plane P1.

Each series of three bends is configured to form a V shape and to guide a wire 131 out of the plane of the facade. This out-of-plane wire increases the horizontal rigidity of the facing member. Horizontal rigidity is understood to mean the resistance to deformation along a horizontal axis. Indeed, like a folded sheet of paper or a corrugated sheet, to impose a deformation along an axis perpendicular to the bends 13, it is necessary to apply compressive or tensile stress to the entirety of each out-of-plane wire 131, which represents significant resistance.

This significant resistance which generates an increase in the horizontal rigidity exists only on the portion of the mesh which comprises out of planes wires. It is therefore possible to generate, in a simple manner, a second series of bends 14 at a level of the metal mesh which does not include out-of-plane wires. In the figure shown, this second series of bends comprises a single bend 14 which makes it possible to form a second face 20 of the member.

This second face 20 which will not be visible on the structure and lies within a plane P2.

The existence of this face generates an increase in the vertical rigidity, in other words the resistance to deformation along a vertical axis. Indeed, the wires 21 parallel to the bend 14 and comprised in face 20 of the member are subjected to compressive or tensile stress when face 10 is stressed, so as to bend in a vertical direction.

Although in FIG. 1 the member has only a single bend 14 along a second curvature, it could include another bend so as to generate a third face at the top of the member which would further strengthen its vertical rigidity. The member could also include several series of three bends along this second orientation in order to offset some wires out of plane, in the manner of wires 131 but in a perpendicular direction.

Different members according to FIG. 1 can be stored and transported when stacked atop one another. The deformations make it possible to limit the gap between members when they are stacked, which is very advantageous.

Figure 2:
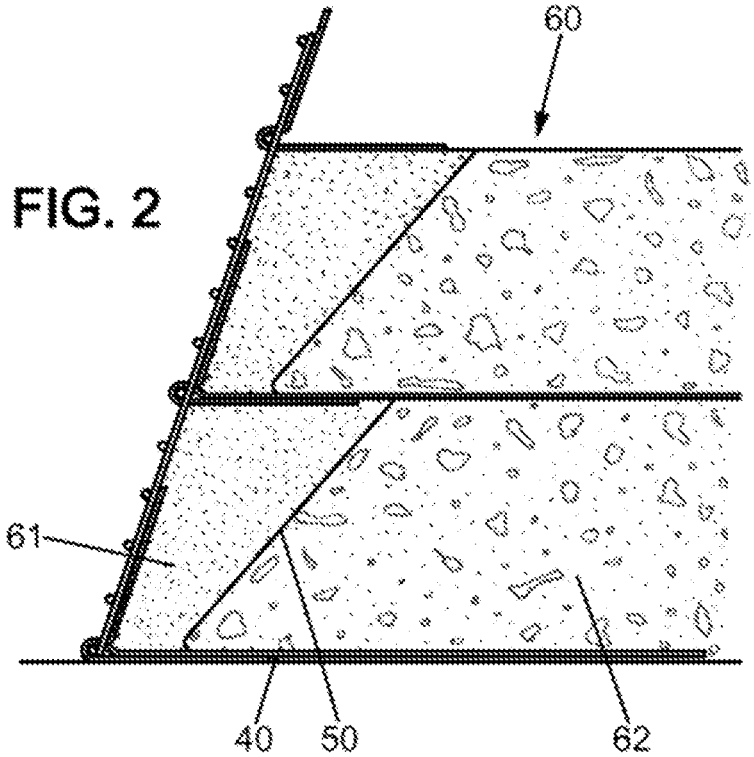
FIG. 2 is a schematic cross-section of a structure according to the invention.
Figure 3:
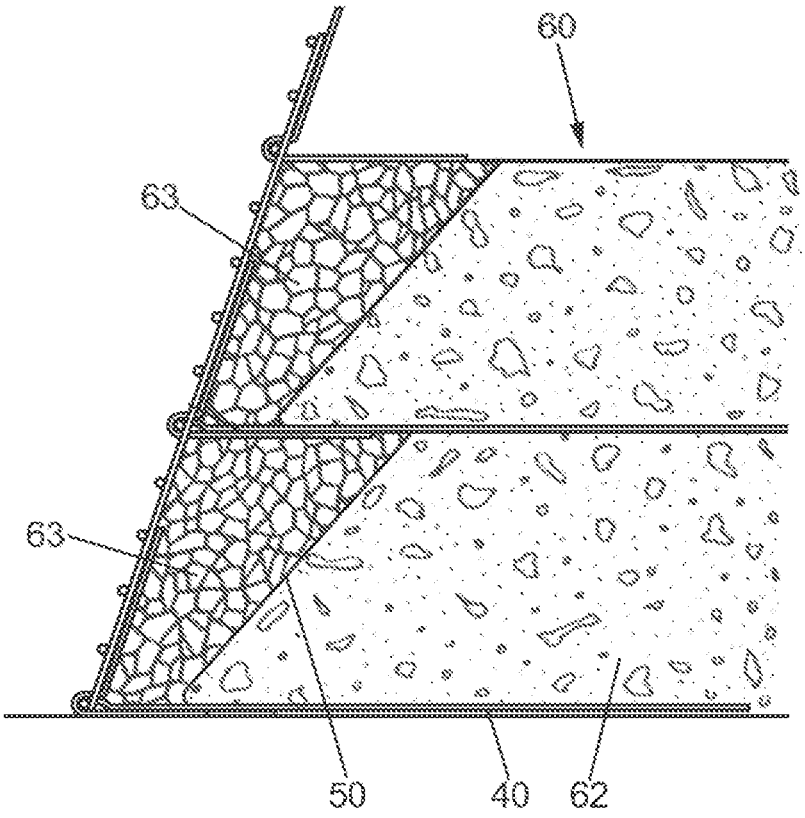
FIG. 3 is a schematic cross-section of a structure according to the invention.

The facing members are used on a structure such as one of those shown in FIGS. 2 and 3.

FIGS. 2 and 3 illustrate schematic cross-sections of structures according to the invention. The general composition of such a structure corresponds to structures known under the brand name TerraTrel® which are offered by Terre Armée International.

Such a structure comprises a plurality of members according to FIG. 1, arranged one atop the other. These members are used to contain fill 60 which can be composed of different materials such as compacted earth 61, a mixture of earth and pebbles 62, pebbles, or rock fragments 63. According to certain embodiments, the fill is composed of several types of fill material. These different types of fill material may be separated by a film, a fabric, in particular by a geofabric 50. It is thus possible to obtain structures whose appearance differs significantly and is chosen according to the desired aesthetics: according to FIG. 2, a layer of surface soil 61 can be placed in contact with the facing, which can then be planted; according to FIG. 3, it is possible to disperse rock fragments, in contact with the facing, which remain visible.

The structure is reinforced by flexible strips 40 which extend into the facing. These flexible strips can be arranged in a horizontal plane perpendicularly or zigzagging relative to the facing.

They are preferably attached to the facing by means of connection means arranged at the offset wires 131 in order to take maximum advantage of the increase in rigidity and to limit the deformations that may occur due to stresses undergone at these attachment points.

They may also be attached to a wall which would be located behind the facing and where the space between this wall and the facing would be filled with fill.

In the case of FIG. 3, it may be advantageous to move the connection devices to behind the facing, taking advantage in particular of face 20. Indeed, it may be advantageous to avoid having flexible strips 40 in the area 63 where the fill is rock fragments, in order to avoid damaging these strips.

The invention is not limited to the examples described above solely by way of example, but encompasses all variants conceivable to those skilled in the art within the framework of the protection sought. In particular, although the example deals with reinforced soil structures, it is quite adaptable to the case of cladding carried out on an existing structure for aesthetic purposes, for example to give it a more mineral appearance.

The invention claimed is:

1. A device for containing granular elements, comprising a metal mesh panel comprising metal wires welded together, the metal mesh panel being formed to have at least a first bend and at least a second bend, the first bend and the second bend having a non-parallel orientation, wherein the metal mesh panel comprises a substantially planar portion and wherein the first bend is arranged to guide an out-of-plane metal wire out of a plane formed by said substantially planar portion of the metal mesh panel, the out-of-plane metal wire having a shorter length than a majority of the metal wires of the metal mesh panel.

2. The device according to claim 1, wherein the non-parallel orientation of the first bend and the second bend is perpendicular.

3. The device according to claim 2, wherein the first bend is parallel to some of the metal wires of the metal mesh panel and wherein the second bend is parallel to others of the metal wires of the metal mesh panel.

4. The device according to claim 1, wherein the metal wires are electro-welded to one another.

5. The device according to claim 1, wherein the metal mesh panel comprises the metal wires having a diameter greater than or equal to 4 mm.

6. The device according to claim 1, wherein the metal mesh panel is associated with a secondary mesh having a mesh size of smaller characteristic dimensions than the metal mesh panel.

7. The device according to claim 6, wherein the secondary mesh is selected from the group consisting of a woven mesh, a biomat, and a geotextile.

8. The device according to claim 1, comprising a plurality of the first bends.

9. The device according to claim 1, comprising a plurality of the second bends.

10. The device according to claim 1, wherein an arrangement of the first bend and the second bend is configured to allow the device to be auto-stable.

11. The device according to claim 1, wherein at least some of the metal wires of the metal mesh panel are provided with a metal coating.

12. The device according to claim 11, wherein the metal coating is selected among zinc and an alloy comprising at least one of zinc and aluminum.

13. The device according to claim 1, wherein the non-parallel orientation of the first bend and the second bend are arranged substantially parallel to said substantially planar portion.

14. The device according to claim 1, wherein the metal mesh panel comprises the metal wires having a diameter between 5 mm and 8 mm.

15. The device according to claim 1, wherein the metal mesh panel further comprises a folded over portion that is configured to fold over the granular elements.

16. A method for manufacturing a device for containing granular elements, the method comprising:

providing a metal mesh panel comprising metal wires welded together;

bending the metal mesh panel in a first orientation to form at least one first bend of a first orientation, the metal mesh panel comprising a substantially planar portion and wherein the first bend is arranged to guide an out-of-plane metal wire out of a plane formed by said substantially planar portion of the metal mesh panel, the out-of-plane metal wire having a shorter length than a majority of the metal wires of the metal mesh panel; and subsequently bending the metal mesh panel in a second orientation that is non-parallel to the first orientation to form at least one second bend of a second orientation.

17. A reinforced soil structure comprising:

a device for containing granular elements, a plurality of the granular elements contained by said device, at least one soil reinforcement member formed of a metal or a polymer material, wherein the device for containing the granular elements comprises a metal mesh panel comprising metal wires welded together, the metal mesh panel being formed to have at least a first bend and at least a second bend, the first bend and the second bend having a non-parallel orientation, wherein the metal mesh panel comprises a substantially planar portion and wherein the first bend is arranged to guide an out-of-plane metal wire out of a plane formed by said substantially planar portion of the metal mesh panel, the out-of-plane metal wire having a shorter length than a majority of the metal wires of the metal mesh panel.

* * * * *